US005092471A

United States Patent [19]

Pinizzotto et al.

[11] Patent Number: 5,092,471

[45] Date of Patent: Mar. 3, 1992

[54] SORTING AND COUNTING TRAY

[76] Inventors: Michael L. Pinizzotto; Nancy J. Pinizzotto, both of Rte. 1, Box 186, Crowley Lake, Calif. 93546

[21] Appl. No.: 608,693

[22] Filed: Nov. 5, 1990

[51] Int. Cl.[5] ..... B07C 7/00

[52] U.S. Cl. ..... 209/614; 141/331; 209/682; 209/929; 414/675; 453/8

[58] Field of Search ..... 209/614, 680, 682, 702, 209/703, 942, 929; 414/675; 53/390; 221/185, 302, 312 R, 312 B, 312 AC; 222/80, 81, 189; 453/8; 141/331, 332, 340; 206/83, 84; 211/10

[56] References Cited

U.S. PATENT DOCUMENTS

| | | | |
|---|---|---|---|
| 884,489 | 4/1908 | Hanson . | |
| 2,664,224 | 12/1953 | Winneberger | 414/675 |
| 2,739,464 | 3/1956 | Smith | 65/15 |
| 2,941,342 | 6/1960 | Allen | 414/675 |
| 2,952,861 | 9/1960 | Reggio | 15/135 |
| 3,169,643 | 2/1965 | Roberts | 414/675 X |
| 3,245,437 | 4/1966 | Holz | 141/331 |
| 4,063,645 | 12/1977 | Canterman et al. | 209/702 |
| 4,244,157 | 1/1981 | Vondra et al. | 53/390 X |
| 4,261,683 | 4/1981 | Zaleon | 209/702 X |
| 4,643,316 | 2/1987 | Hoffmann | 209/702 |

FOREIGN PATENT DOCUMENTS

| | | | |
|---|---|---|---|
| 224379 | 6/1958 | Australia | 222/541 |
| 2170121 | 7/1986 | United Kingdom | 141/331 |

*Primary Examiner*—Donald T. Hajec
*Attorney, Agent, or Firm*—Milton S. Gerstein

[57] ABSTRACT

A tray for receiving a multiplicity of small objects, such as pills, nuts and bolts or sundry items, to be sorted and/or counted. The tray includes an integral funnel-shaped outlet for dispensing or discharging the sorted and counted objects. A series of score lines or lines of weakness are provided around the surface of the funnel-shaped outlet at its discharge end to enable the discharge end of the outlet to be cut to a desired diametrical outlet size corresponding to the size of the objects to be counted out and/or sorted in the tray and poured through the funnel-shaped into a dispensing or storage bottle or container. In a second embodiment, removably-securable separate funnel-sections are provided, with each having the size entrance mouth but different size exit mouth.

10 Claims, 2 Drawing Sheets

60

60

68
70
68

66
70
68

62
64
78
80

66
70
68
60

74
78
76
80

SORTING AND COUNTING TRAY

BACKGROUND OF THE INVENTION

The present invention relates to a tray for sorting and counting medicinal items such as pills and capsules, buttons, food items such as beans, hardware items such as nuts, bolts and screws, and like small objects of different size from a bulk supply of mixed sizes of such objects and for pouring the sorted and/or counted objects of a selected size into a storage or dispensing bottle or container.

A number of counting tray designs have been proposed for use by pharmacists for counting out pills and capsules. U.S. Pat. Nos. 2,664,224, 2,812,076, 2,952,369, 3,819,064 and 4,261,683 are illustrative of prior art inventions relating to counting tray designs. All of the tray designs of these patents include pour spouts or discharge means through which sorted or counted quantities of pills or capsules are poured into a container or bottle. Trays of similar design have been used for hardware items and for sorting and counting small notion or sundry items.

SUMMARY OF THE INVENTION

There is provided, in accordance with the present invention, an improved sorting and counting tray for receiving a multiplicity of small objects. The tray, in a first embodiment, is provided with an integral funnel-shaped outlet for dispensing or discharging sorted and/or counted out quantities of such objects. More particularly, the invention relates to an object sorting and counting tray, with unitary funnel-shaped outlet, for use in the sorting and/or counting of small objects of like or varying type or size distribution and for discharging like objects that have been sorted and/or counted within the tray through the outlet to a dispensing or storage bottle or container.

In the first embodiment, marking lines, score lines or lines of weakness are provided around the surface of the funnel-shaped outlet at its discharge end to enable the discharge end of the outlet to be cut off to a desired diametrical outlet size corresponding to the size of the objects to be counted out and/or sorted in the tray and poured through the funnel-shaped outlet into a dispensing or storage bottle or container. The entire sorting and counting tray structure with funnel-shaped outlet is of one piece construction and is preferably inexpensively molded from a plastic material.

In a second embodiment, there is provided a plurality of funnel portions, each of different size and each of which is removably securable to a main holding section into which main section the pieces to be separated, sorted, and/or poured are first placed for subsequent pouring into a container, jar, bottle, or the like. The bottom or lower rim of each funnel has a diameter that suits it to placement into the top of the container , bottle, or the like, to ensure complete, easy and safe pouring without spillage.

BRIEF DESCRIPTION OF THE DRAWING

A more complete understanding of the present invention will be had upon reference to the following detailed description when read in conjunction with the accompanying drawing, wherein like reference characters refer to like parts throughout the several views, and in which.

DETAILED DESCRIPTION OF THE INVENTION

Figure 1:
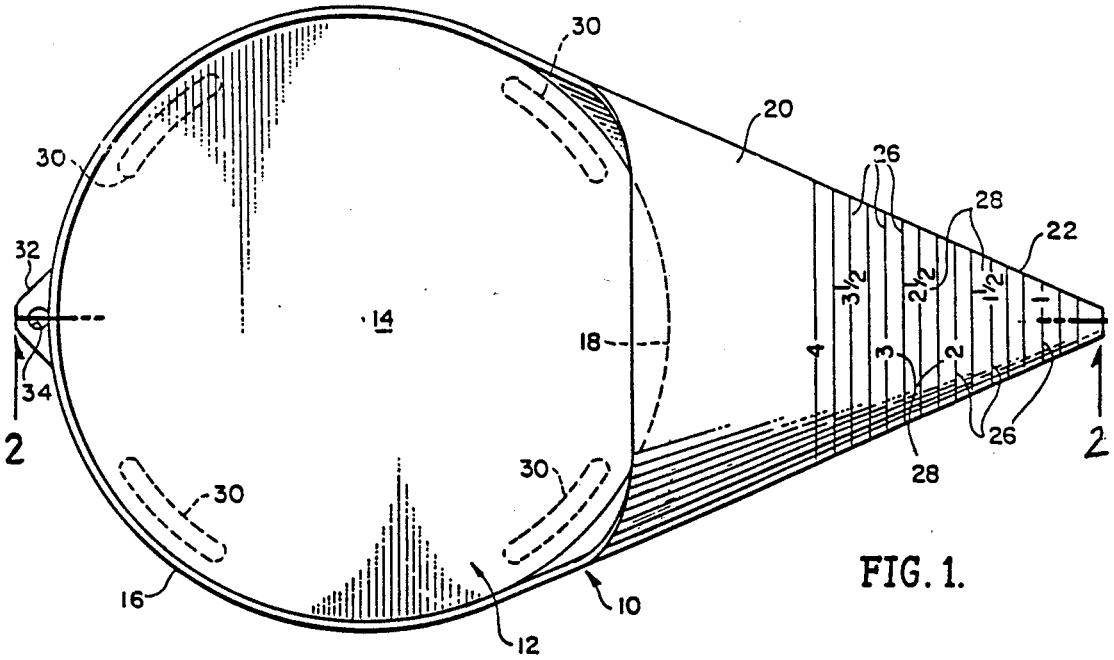
FIG. 1 is a top plan view of the sorting and counting tray structure of the present invention.
Figure 2:
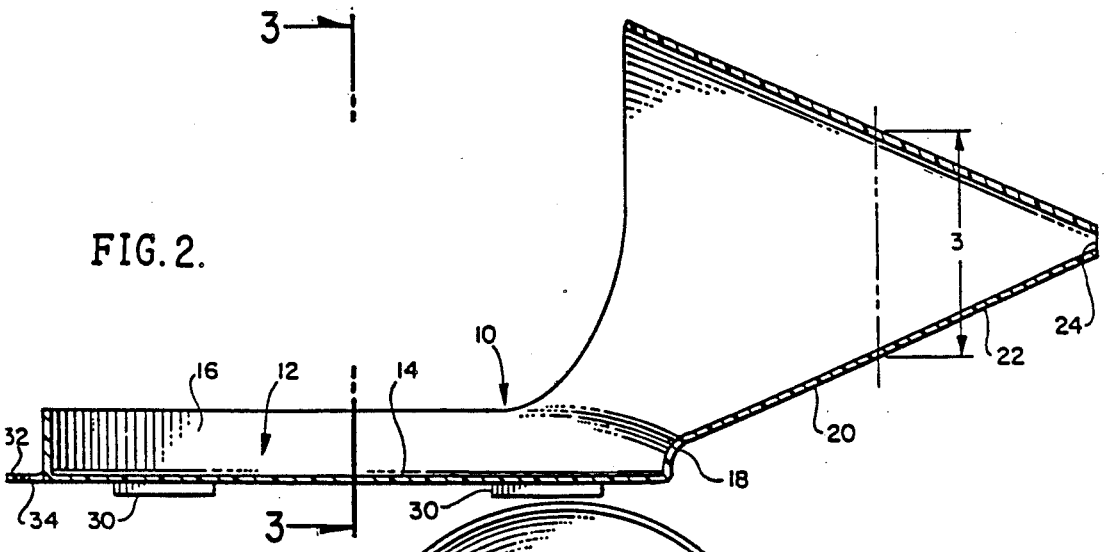
FIG. 2 is a cross-sectional view of the sorting and counting structure of the invention taken along section line 2—2 of FIG 1.
Figure 3:
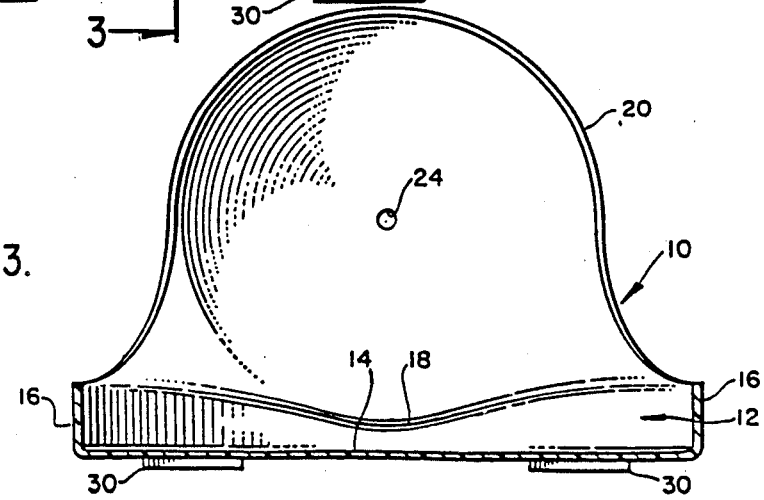
FIG. 3 is a cross-sectional view of the tray structure of the invention taken along section line 3—3 of FIG. 2.
Figures 4, 5, 6, 7, 8, 9, 10, 11, 12:
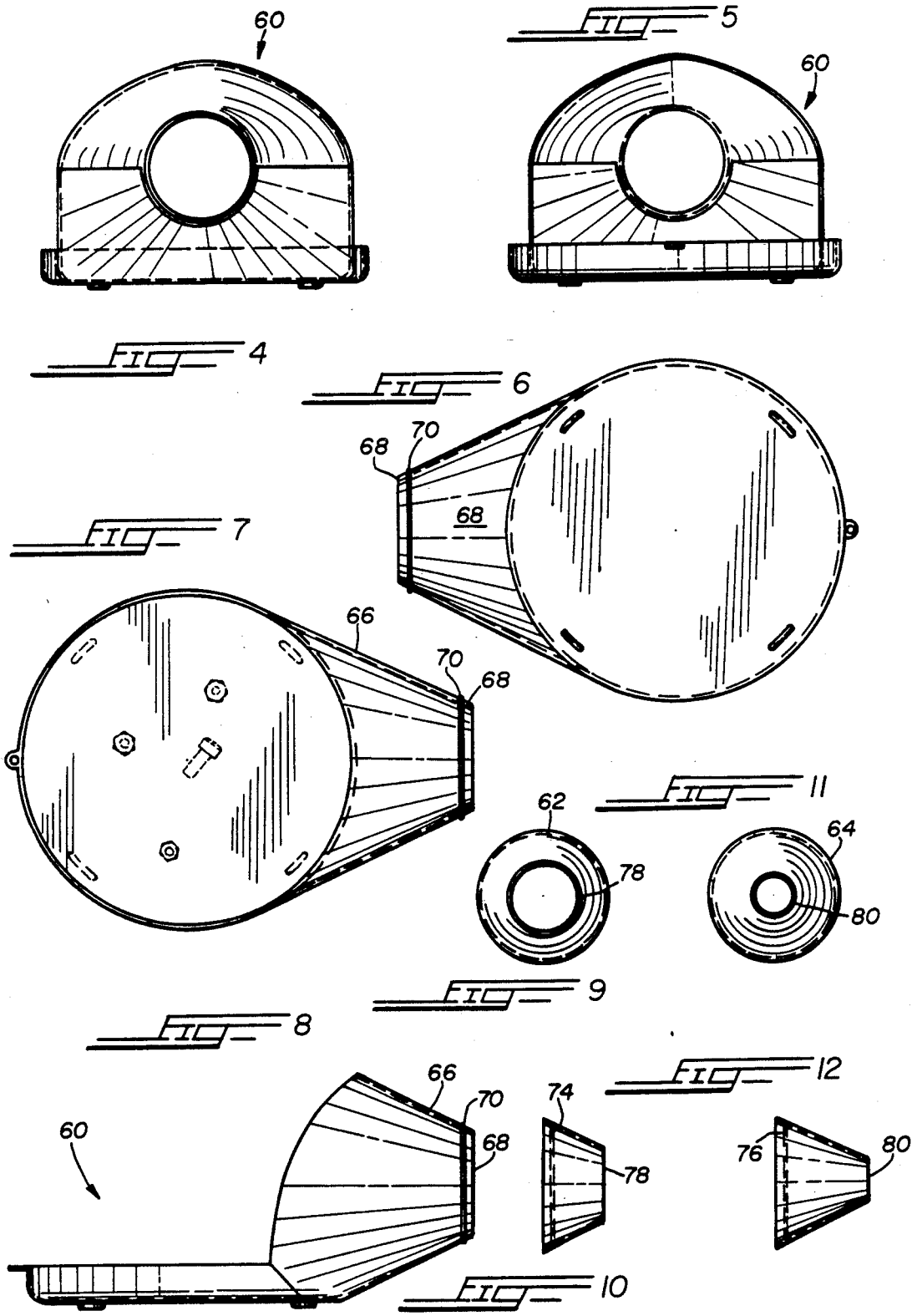
FIG. 4 is a first end view of a second embodiment of the invention and showing the main container-section thereof.
FIG. 5 is a second end view thereof.
FIG. 6 is a bottom view thereof.
FIG. 7 is a top view thereof.
FIG. 8 is a side view thereof.
FIG. 9 is an end view of a first detachable funnel-section for use with the main container-section.
FIG. 10 is a side view thereof.
FIG. 11 is an end view of a second detachable funnel-section of different, smaller lower diameter.
FIG. 12 is a side view thereof.

Referring to the FIGS. 1-3, there is shown a first embodiment of the invention having a tray and funnel-shaped outlet structure 10 for receiving a multiplicity of small objects to be sorted and/or counted, and thereafter poured into a dispensing or storage bottle or container. The tray portion 12 of structure 10 is comprised of a generally circular flat bottom wall 14 and a side wall 16 which encircles the bottom wall 14 and extends upwardly therefrom. The forward portion 18 of the side wall 16 is of reduced height and merges into an integral funnel portion 20 of the unitary tray-funnel structure 10. The funnel portion 20 terminates at its forward end into a pour-end 22 and is provided with an orifice 24.

As shown in FIG. 1, the forward pour-end 22 of funnel portion 20 is provided with a series of spaced marking lines or annular score lines or lines of weakness 26. These lines enable the user of the tray-funnel structure 10 to select an annular plane across the pour-end 22 through which to cut such pour-end to form a new orifice of desired diametrical outlet size corresponding to the size of the objects to be sorted and/or counted in the tray and poured from the tray through the funnel portion thereof into a container. Associated with the annular marking lines or score lines 26 are numerical indicia 28 comprising consecutive integers corresponding to the internal diameter of the funnel-shaped outlet portion at the respective annular marking lines or score lines 26. Thus, the indicia integers specify the diameter of the new orifice that will be obtained by cutting through the pour end 22 of the funnel portion 20 at a given marking line or score line.

The bottom 14 of the tray-funnel structure 10 may be provided with support legs 30 and a bracket 32 with perforation 34 for storage-hanging of the tray-funnel structure when it is not in use. As previously indicated, the unitary tray structure may be formed of a suitable plastic material by any of a number of known molding techniques.

In use of the tray-funnel structure of the invention, a bulk supply of objects to be sorted and/or counted is poured into the tray portion 12 of the structure 10. If the objects are of uniform size and merely require counting before being placed in a secondary storage or dispensing container, the tray-funnel structure is prepared (before the loading of the structure with objects to be counted) by cutting off an appropriate portion of the pour end 22 of the funnel portion 20 of the structure to obtain a pour-orifice 24 having a diameter matching the diameter or maximum size of the objects to be counted. In cases where the bulk supply of objects to be sorted and/or counted includes objects of varying size, the unsorted supply of objects may be first placed in a tray-funnel structure 10 having a prepared orifice 24 that is of slightly smaller diameter than the desired object size, so that smaller objects may be poured out of the structure 10 with the objects of desired size and larger being retained in the tray portion 12. Thereafter, the retained mixture of objects is placed in a different tray-funnel structure 10 having a prepared orifice 24 that corresponds in diameter to the desired object size so that only objects of the desired size may be poured from such tray-funnel structure, or the very same tray structure may then be cut along another, larger score line to make the larger-sized funnel pour-orifice. However, it is preferable to use two different tray structures 10 so that each may be used over again.

As mentioned above, the tray structure 10 of the invention (which is provided at the pour-end 22 of its funnel portion 20 with a series of spaced annular marking lines or score lines 26 for the selection of a desired diametrical funnel outlet size) is ideally suited for use in sorting and/or counting bulk quantities of medicinal items (such as pills and capsules), hardware items (such as nuts, bolts and screws), and notion or sundry items (such as buttons).

A second embodiment of the invention is shown in FIGS. 4–10, and includes a separate main holding section 60 shown in FIGS. 4–8, and separate and removably-securable funnel-sections 62, 64 of different lower, or bottom, diameters shown in FIGS. 9–12. The main tray or holding section 60 is similar to the tray 12 of the first embodiment, with the major difference being that the tray or holding section 60 terminates in a frustro-conical funnel-holding section 66 defining a funnel-attaching end 68 having an annular rib or bead 70 by which the separate funnel-sections 62 or 64 may be removably attached to the tray section 60. Each funnel-section has a frustro-conical shaped funnel, and has an inlet opening in which is provided an interior, annular bead or rim 74, 76, respectively, that cooperates with the annular bead 70 for a snap-fit connection between the funnel-section 74 or 76 and the funnel-holding section 66. Like the tray 12, the funnel-holding section 66 has a height that rises substantially above the horizontal plane defining the upper support surface 14 of the tray 14. Each funnel section's inlet opening is the same size and extent, with the difference between the funnel section 74 and funnel-section 76 being the length thereof, by which the respective outlet, or pour-end, 78, 80 is of different diametric extent; thus, the angular slope of each frustro-conical funnel-section 74, 76 is the same, with the length of each only being different, as explained. Each funnel section has a taper substantially equal to the taper of the frustro-conical funnel-mounting section.

It is, of course, possible to provide more than two such funnel-sections, each having the same size inlet opening, but each being of a different length and, thereof, each defining a differently-sized outlet or pour-end. By having the lower end 68 fit inside the inlet opening of each funnel-section, small items being sorted and/or poured will not be exposed to any interior transition surfaces at which they might become caught, snared, or the like. It is also possible to provide a plurality of like funnel-sections 76, with each having annular score lines or marks similar to the lines 26 of the first embodiment, so that each funnel-section may then be cut down by each individual to suit his or her specific needs and uses, with each funnel section, after being cut down, having a different length and differently-sized outlet opening, but the same size inlet opening. Each lower outlet opening may also be so chosen so as to define an annular circumference that fits snugly into the interior opening of a container, bottle, or the like, into which the items being sorted and/or poured may be poured. Thus, the funnels may be used with different containers having entrance mouths of different size.

While specific embodiments of the invention have been shown and described, it is to be understood that numerous changes and modifications may be made therein without departing from the scope, spirit and intent of the invention as set forth in the appended claims.

What is claimed is:

1. Apparatus for sorting and counting small objects comprising:

a) a tray-type housing having a bottom wall and a side wall which encircles the bottom wall at the rim thereof and extends upwardly therefrom, said side wall being of reduced height in the area of a forward portion of said housing;

b) a frustro-conical-like funnel mounting section connected to and forming an integral forwardly projecting part of said tray-type housing at said forward portion thereof, said funnel-mounting section having an object entrance mouth at one end and an object discharge mouth at its other end; and c) at least two funnel sections for removable securement to said funnel-mounting section;

d) said funnel-mounting section comprising first mounting means for removably securing one of said at least two funnel sections;

e) each of said funnel sections comprising second mounting means for cooperating with said first mounting means for removably securing the respective said funnel section to said funnel-mounting section;

f) each of said funnel sections comprising an open mouth entrance of the same size and dimensions, and each funnel section comprising an open exit mouth having a size and dimension different from any other said funnel section.

2. The apparatus according to claim 1, wherein said first mounting means comprises an inner annular bead, and each said second cooperating means comprises an outer annular bead.

3. The apparatus according to claim 2, wherein said open mouth entrance of each said funnel section has a diameter greater than the diameter of said discharge mouth of said funnel-mounting section, whereby each said funnel section may be partially, telescopingly-mounted about said discharge mouth of said funnel-mounting section.

4. The apparatus according to claim 3, wherein said inner annular bead of said first mounting means of said funnel-mounting section is in close juxtaposition to said discharge mouth of said funnel-mounting section; and said outer annular bead of each said funnel section is in close juxtaposition to said open mouth entrance thereof.

5. The apparatus according to claim 3, wherein said funnel-mounting section comprises a circular cross section, and each said funnel section comprises a circular cross section.

6. The apparatus according to claim 5, wherein the length of each said funnel section is different from the length of at least the other of said funnel sections.

7. The apparatus according to claim 6, wherein each said funnel section is frustro-conical comprising an outer surface having a taper substantially equal to the taper of the frustro-conical funnel-mounting section.

8. A method of sorting objects for storage in a container, comprising:

a) placing a plurality of objects to be poured into a container onto a tray-support structure having a support-surface and funnel-mounting portion;

b) removably securing a first end of a first funnel section to the funnel-mounting portion where the interior of the first funnel section opens up to the tray-support surface;

c) placing a second end of the first funnel section into a mouth of a container;

d) tilting the tray-support structure and pouring the plurality of objects through the first funnel section into the container;

e) removing the first funnel section from the tray-support structure;

f) removably securing to the funnel-mounting portion a second funnel section having the same inlet size as the first funnel section and having a different outlet size from the first funnel section;

g) placing the exit end of the second funnel section into a mouth of a different container having an entrance mouth of different size than the container used in said step (d);

h) tilting the tray-support structure and pouring objects through the second funnel section into the different container.

9. The method according to claim 8, wherein the first funnel section has an exit mouth smaller than the exit mouth of said second funnel section, whereby smaller objects may be sorted out from larger objects.

10. The method according to claim 8, wherein each of said steps (b) and (f) comprises telescoping the entrance of the funnel section over the exit of the funnel-mounting section.

* * * * *